US007559783B2

(12) United States Patent
Ripper et al.

(10) Patent No.: US 7,559,783 B2
(45) Date of Patent: Jul. 14, 2009

(54) PLUG

(75) Inventors: Hartmut Ripper, Darmstadt (DE); Gabriel Hotea, Offenbach (DE); Mile Trajkov, Frankfurt (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/067,011

(22) PCT Filed: Sep. 13, 2006

(86) PCT No.: PCT/EP2006/008927

§ 371 (c)(1),
(2), (4) Date: Mar. 14, 2008

(87) PCT Pub. No.: WO2007/031302

PCT Pub. Date: Mar. 22, 2007

(65) Prior Publication Data

US 2008/0248668 A1 Oct. 9, 2008

(30) Foreign Application Priority Data

Sep. 14, 2005 (DE) ..... 10 2005 043 903

(51) Int. Cl.
*H01R 29/00* (2006.01)

(52) U.S. Cl. ..... 439/188

(58) Field of Classification Search ..... 439/352, 439/188, 489, 507, 620.05
See application file for complete search history.

(56) References Cited

U.S. PATENT DOCUMENTS

| | | | | |
|---|---|---|---|---|
| 5,591,041 | A * | 1/1997 | Cecil et al. | 439/352 |
| 5,611,045 | A * | 3/1997 | Basile | 714/47 |
| 6,276,953 | B1 | 8/2001 | Gauker et al. | |
| 6,328,589 | B1 * | 12/2001 | Annecke | 439/352 |
| 6,364,683 | B1 * | 4/2002 | Kohno | 439/352 |
| 6,419,510 | B2 * | 7/2002 | Shiraki et al. | 439/188 |
| 6,544,060 | B2 * | 4/2003 | Wakui et al. | 439/188 |
| 6,739,913 | B2 * | 5/2004 | Hayashi | 439/620.05 |
| 6,743,051 | B2 * | 6/2004 | Hayashi | 439/620.05 |
| 6,799,999 | B2 * | 10/2004 | Williamson et al. | 439/676 |
| 6,811,424 | B2 * | 11/2004 | Seminara et al. | 439/352 |
| 6,893,277 | B2 * | 5/2005 | Parrish et al. | 439/188 |
| 6,910,902 | B2 * | 6/2005 | Osada | 439/188 |
| 7,131,854 | B1 * | 11/2006 | Pavlovic et al. | 439/352 |

FOREIGN PATENT DOCUMENTS

EP 1184232 A2 3/2002

* cited by examiner

*Primary Examiner*—Alexander Gilman
(74) *Attorney, Agent, or Firm*—Barley Snyder LLC

(57) ABSTRACT

A plug for a socket of an airbag is disclosed. The plug has a position assurance member having a movable member and a static member and the position assurance member is movable between a transport position and an end position by moving the movable member in relation to the static member. The plug also has a shorting contact, a flow of current in the shorting contact being possible in the transport position while the flow of current is not possible in the end position. The end position is attainable only when the plug is inserted into the socket.

16 Claims, 4 Drawing Sheets

PLUG

CROSS-REFERENCE TO RELATED APPLICATION DATA

This application claims the benefit of the earlier filed International Patent Application No. PCT/EP2006/008927 having a filing date of Sep. 13, 2006 and that claims the benefit of the earlier filed German Patent Application No. DE 10 2005 043 903.9 having a filing date of Sep. 14, 2005.

FIELD OF THE INVENTION

The present invention relates to the field of plugs, and more particularly, to the field of plugs for airbags.

BACKGROUND

U.S. Pat. No. 6,276,953 B1 describes a plug of the type in which a sparking contact normally provided in an ignition coil is integrated into the plug. A shorting contact is broken so that current cannot flow in the shorting contact by pushing in a position assurance member, which is fitted at a side of the plug. When the plug is not inserted, the position assurance member is in an initial position in which current can flow in the shorting contact. Pushing the position assurance member into the plug and hence breaking the shorting contact so that current can not flow in the shorting contact is not possible in the initial position.

It is only by inserting the plug into the socket that a flexural member, which has prevented the position assurance member from being pushed in, is removed and that the shorting contact can be broken so that current cannot flow in the shorting contact. At the same time, an arm of the position assurance member fixes the plug in the socket and prevents the plug from being removed from the socket. Moving the shorting contact into the plug increases the complexity of the plug and is, moreover, not equally suitable for all customary sockets. It also impairs handling of the plug.

In the case of a plug known from EP 0 600 418 B1, a shorting contact located in a socket of an airbag is broken when the plug is inserted into the socket. This takes place when a front end of a plastic casing of the plug is pushed between a contact pin and a contact spring of the socket. When the plug is plugged in, the plug is initially inserted into the socket until the socket meets resistance. The plug is then pushed with force past the resistance until the plug breaks the shorting contact so that current cannot flow in the shorting contact and engages with several projections on the socket. As it engages, the plug is fixed on the socket. Since fixing and breaking of the shorting contact takes place simultaneously, measurements, for example, for testing or checking purposes are not possible once the plug is inserted. This is a marked disadvantage.

SUMMARY

The present invention relates to, in one embodiment among others, a plug for a socket of an airbag. The plug has a position assurance member having a movable member and a static member and the position assurance member is movable between a transport position and an end position by moving the movable member in relation to the static member. The plug also has a shorting contact, a flow of current in the shorting contact being possible in the transport position while the flow of current is not possible in the end position. The end position is attainable only when the plug is inserted into the socket.

BRIEF DESCRIPTION OF THE DRAWINGS

An embodiment of the invention is described herein with reference to the following figures wherein.

DETAILED DESCRIPTION OF THE EMBODIMENTS

It is therefore desirable to develop a plug 1 that has a simple construction, is easy to handle, and enables purposive breaking of the shorting contact 34 at a given moment in time.

Figure 1:
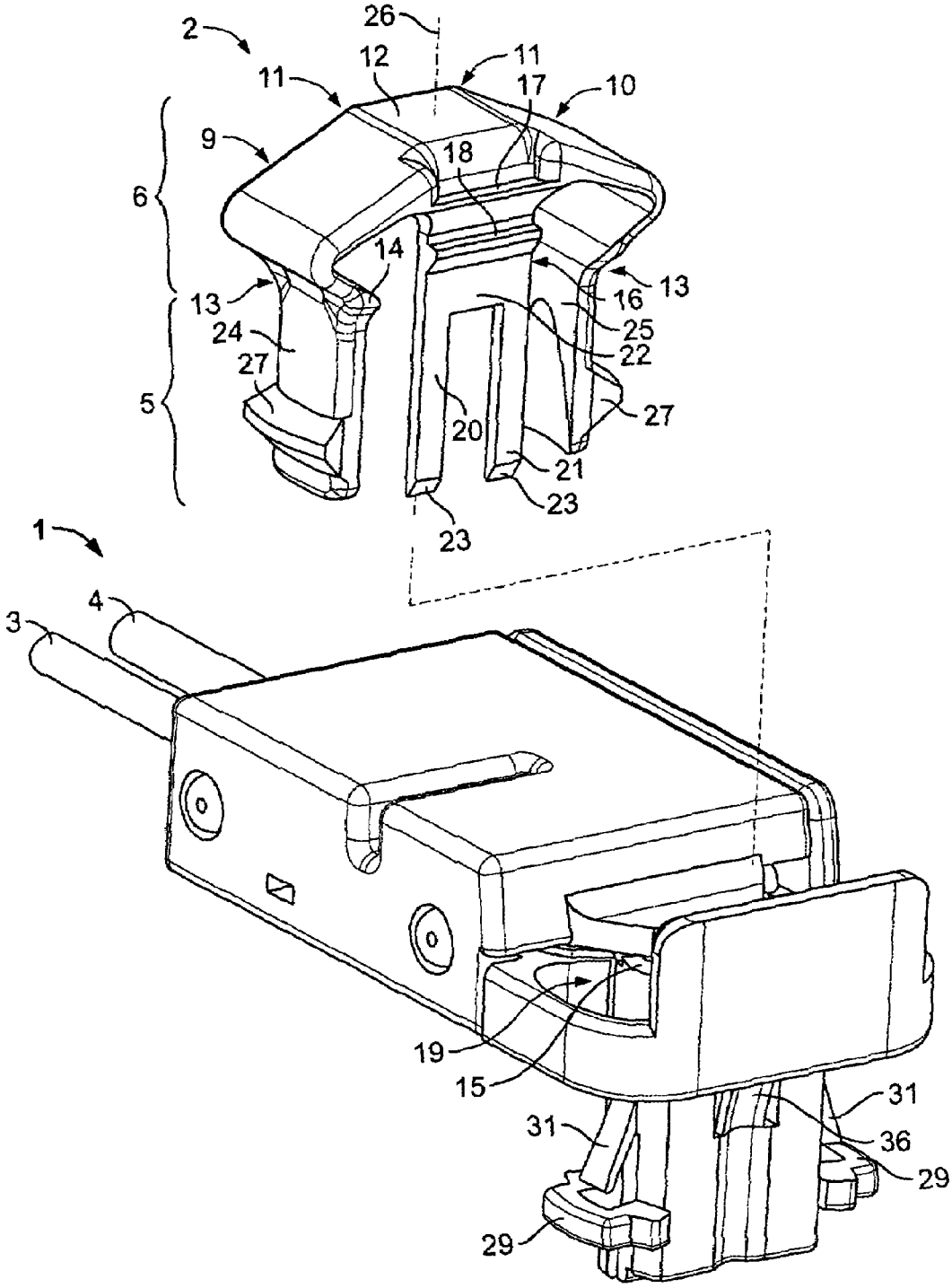
FIG. 1 is an exploded view of a plug in accordance with the invention showing a position assurance member removed from the plug.

FIG. 1 shows an embodiment of a plug 1 in accordance with the invention with a position assurance member 2 illustrated separately. In this embodiment, the plug 1 has first electrical leads 3 and second electrical leads 4 that extend inside the plug 1. At least one of the first electrical leads 3 and second electrical leads 4 is connected to a choke.

The position assurance member 2 is substantially bow shaped and includes a static member 5 and a movable member 6. The movable member 6 of the position assurance member 2 has opposing substantially V-shaped spring members, specifically, first spring members 9 and second spring member 10, which are connected with each other at an activator end 11 of each via an activator 12 that is substantially horizontal. At an opposing plug arm end 13, first spring member 9 and second spring member 10 each have an opening and an abutment member 14, which when the position assurance member 2 is inserted into the plug 1 comes to rest on a shoulder 15 of the plug 1 to serve as an abutment for the first spring member 9 and the second spring member 10.

Starting from the activator 12, an arm 16 that is substantially wide and extends downward and approximately perpendicularly to the activator 12. At an upper end of the arm 16 and in the immediate vicinity of the activator 12, the arm 16 is provided with a first catch 17 and a second catch 18, both being downward sloping, and which on insertion into a first recess 19 of the plug 1, engage the plug projection 30 of the plug 1. At a lower end of the arm 16 and away from the activator 12, the arm 16 divides into two finger-like extensions, specifically, a first extension 20 and a second extension 21 which are connected by a base 22 that runs approximately at a right angle to the first extension 20 and the second extension 21. At tips 23 thereof, the first extension 20 and the second extension 21 are slightly beveled.

In this embodiment of the invention the static member 5 of the position assurance member 2 consists of substantially wide plug arms, specifically, first plug arm 24 and second plug arm 25, which in relation to the a longitudinal axis 26 of the plug 1 are arranged approximately opposite each other. The first plug arm 24 and second plug arm 25 are slightly rounded to adapt to the shape of the socket 33. In addition, each of the first plug arm 24 and second plug arm 25 has a plug arm projection 27, which is approximately trapezoidal in cross section that also adapts to the slightly rounded shaped of the first plug arm 24 and second plug arm 25.

In this embodiment, the position assurance member 2 is made from plastic, and the movable member 6 and the static member 5 of the position assurance member 2 are made in one piece. It is therefore easy to manufacture the position assurance member 2 by, for example, injection molding or another casting process. Alternatively, the position assurance member 2 can be made of several components. In this case, care must be taken that at least the finger-like first extension 20 and second extension 21 consist of an electrically non-conductive material.

Figure 2:
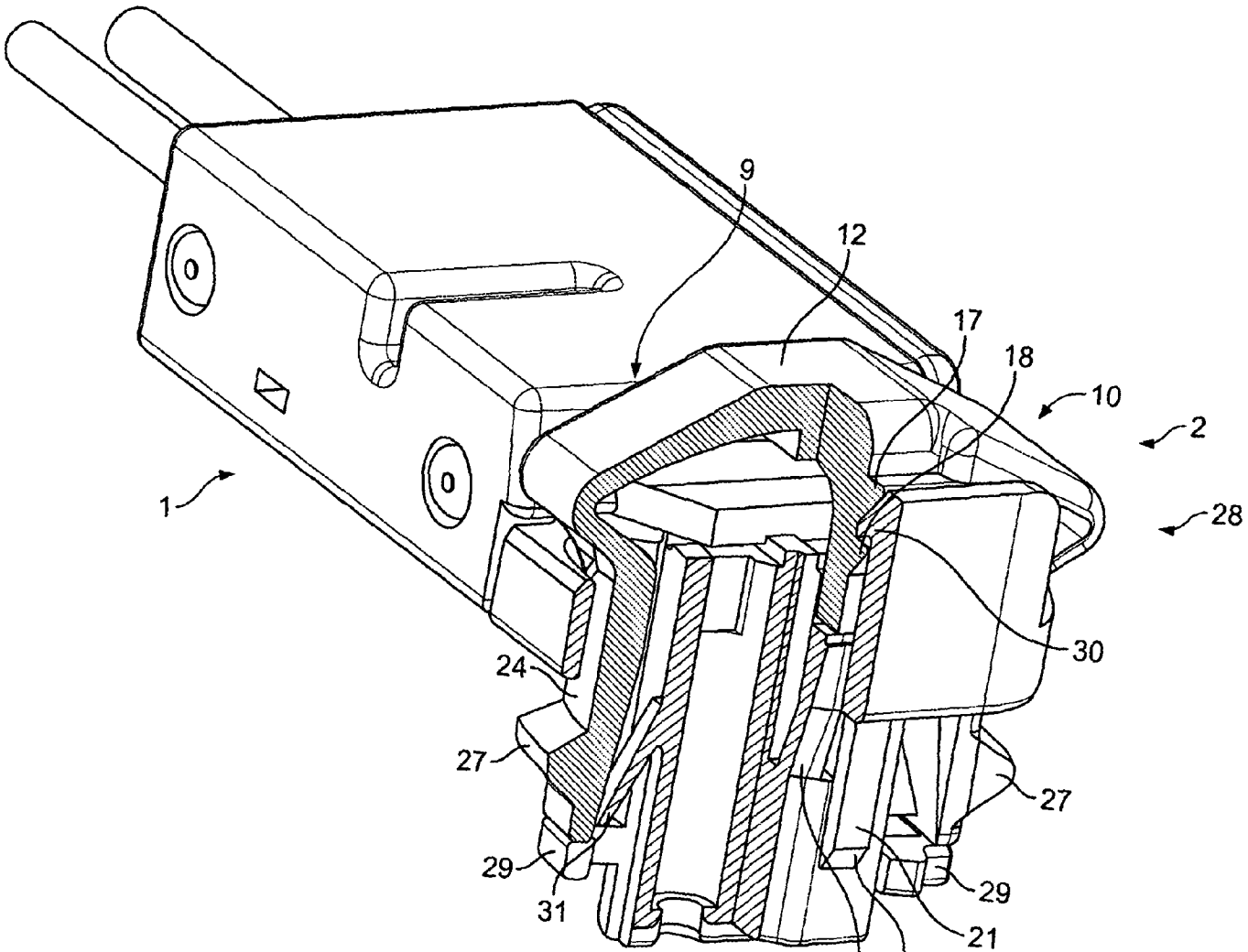
FIG. 2 is a partial sectional view of the plug in accordance with the invention with the position assurance member inserted therein in a transport position.

FIG. 2 shows the plug 1 with the position assurance member 2 inserted into the first recess 19. The position assurance member 2 is in an initial position or transport position 28 in FIG. 2. The first plug arm 24 and second plug arm 25 of the static member 5 of the position assurance member 2 rest in each case on a stop 29 of the plug 1. The first plug arm 24 and second plug arm 25 are supported by first spring arms 31 of the plug 1, which abut against an inside of the first plug arm 24 and second plug arm 25.

In this position, the second catch 18 locks behind a plug projection 30 of the plug 1 adjacent to a second spring arm 36 of the plug 1. In this embodiment, the second spring arm 36 engages between the first extension 20 and the second extension 21 and abuts against the base 22 of the first extension 20 and the second extension 21 of the movable member 6 of the position assurance member 2. The transport position 28 of the position assurance member 2 is thus unequivocally determined and fixed by the stops 29, the second catch 18, and the second spring arm 36.

Figure 3:
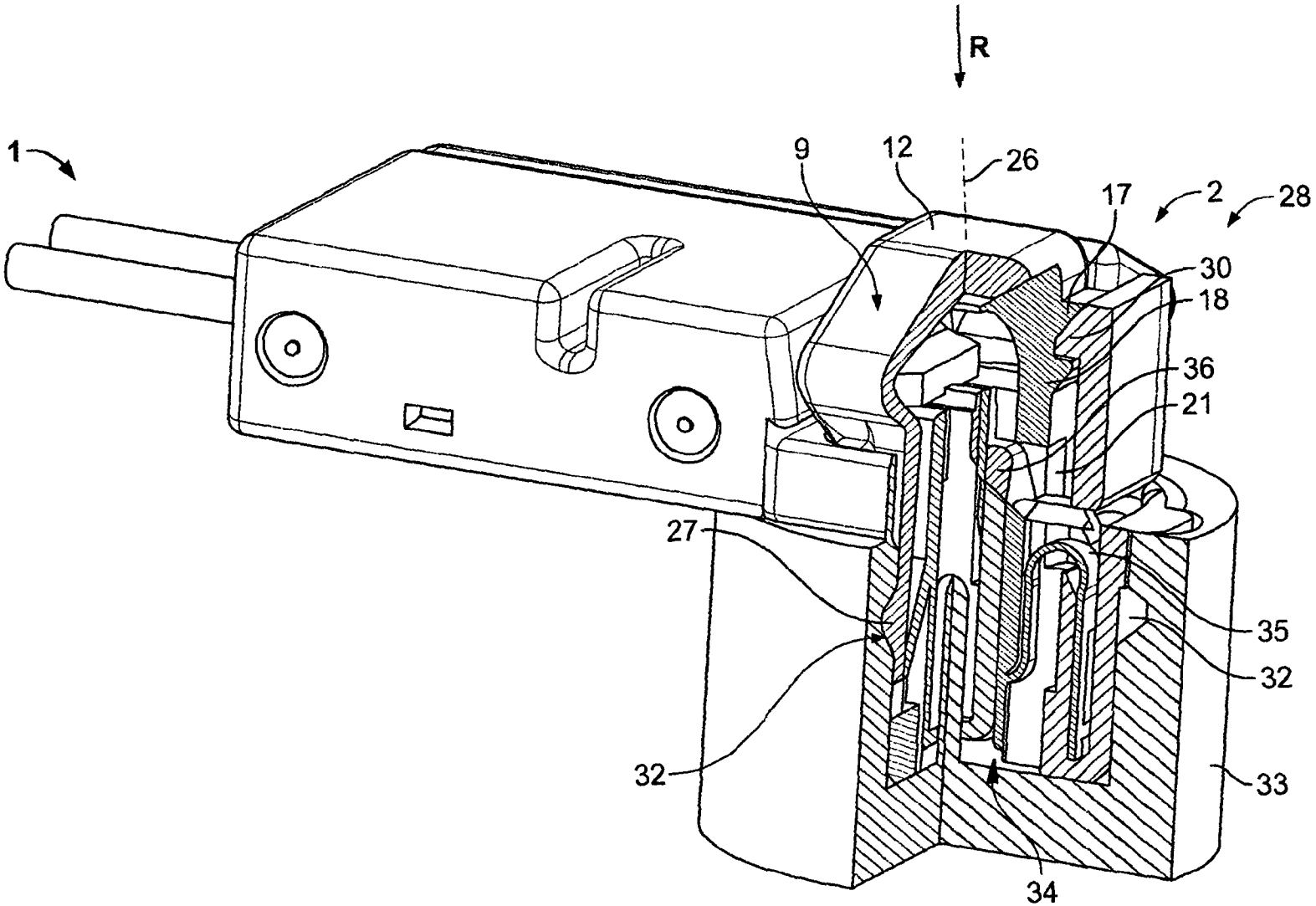
FIG. 3 is a partial sectional view of the plug in accordance with the invention showing the plug plugged into a socket and the inserted position assurance member in the transport position.

FIG. 3 shows the plug 1 with the position assurance member 2 in the transport position 28 and plugged into the socket 33. The socket 33 has a shorting contact 34. In this position, the plug projections 30 and the first plug arm 24 and second plug arm 25 engage in second recesses 32 of the socket 33.

A contact spring 35 of the shorting contact 34 is in an initial position in the transport position 28 such that a current flow is possible via the shorting contact 34.

When the plug 1 is plugged into the socket 33, second spring arm 36 of the plug 1 is disengaged from the first extension 20 and the second extension 21 of the movable member 6 of the position assurance member 2 and releases the base 22 of the first extension 20 and the second extension 21 and hence the movable member 6 of the position assurance member 2. The position assurance member 2 can now be moved further in a direction of the shorting contact 34.

Figure 4:
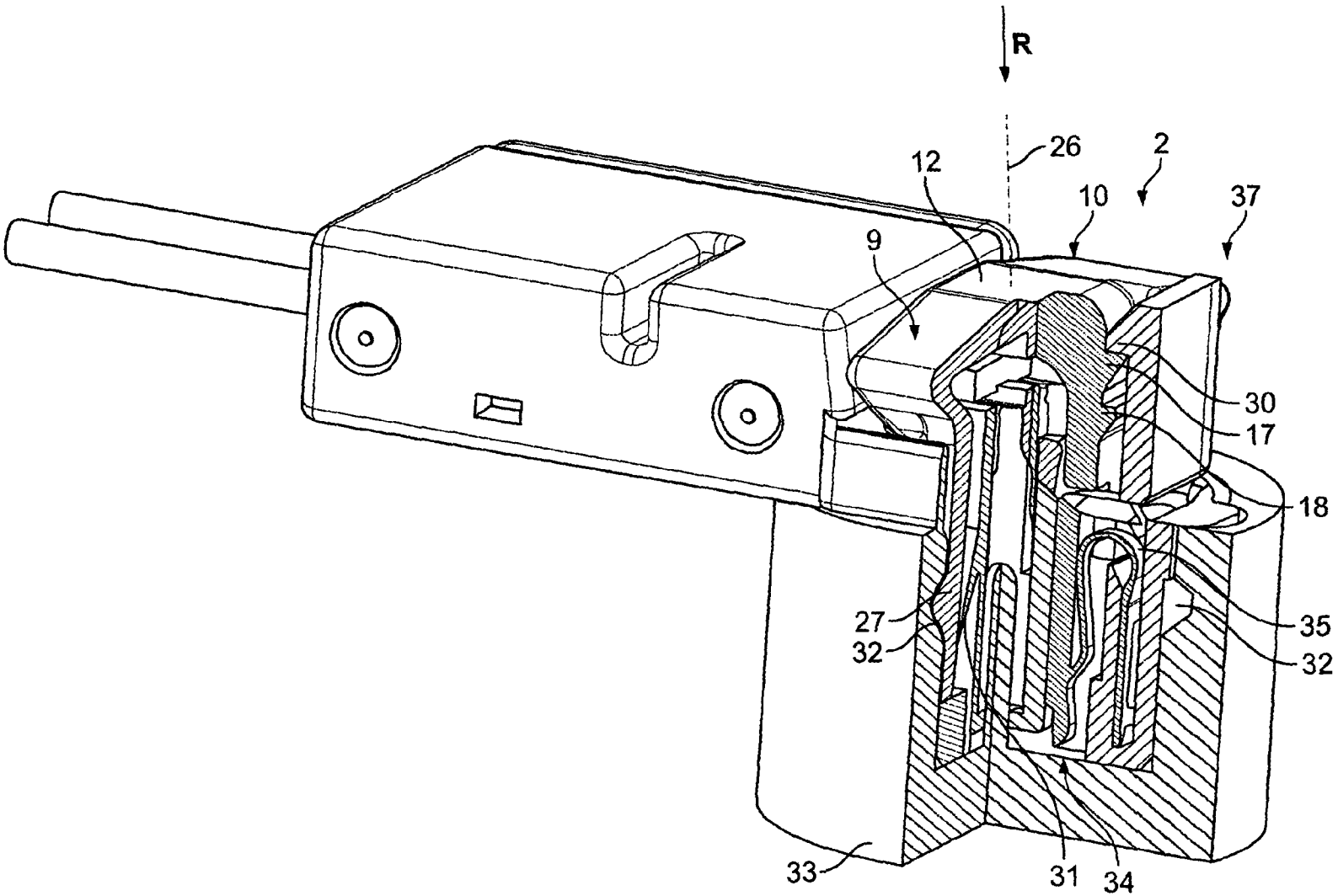
FIG. 4 is a partial sectional view of the plug in accordance with the invention showing the plug plugged into the socket and the inserted position assurance member in an end position.

FIG. 4 shows the plug 1 with the position assurance member 2 in an end position 37 wherein the plug 1 is plugged into the socket 33. The position of the static member 5 of the position assurance member 2 in the end position 37 corresponds to the position of the static member 5 in the transport position 28. The plug arm projections 27 of the first plug arm 24 and second plug arm 25 remain engaged in the second recesses 32 in the socket 33 in the end position 37. Compared with the transport position 28, the movable member 6 of the position assurance member 2 is shifted downwards in a direction of the socket 33. The first catch 17 is now engaged with the plug projection 30 of the plug 1. In the end position 37, compared with the transport position 28, the first extension 20 and the second extension 21 are displaced slightly downward and press against the contact spring 35 of the shorting contact 34 of the socket 33. The shorting contact 34 is therefore broken.

The method of use of the plug 1 according to the invention illustrated in FIGS. 1-4 will now be explained.

The position assurance member 2 is inserted into the recess first 19 of the plug 1 and pushed downward until the tips 23 of the first plug arm 24 and second plug arm 25 abut against the stops 29 of the plug 1. At the same time, the abutment members 14 of the first spring member 9 and the second spring member 10 of the movable member 6 of the position assurance member 2 come to abut against the shoulders 15. Because the first plug arm 24 and second plug arm 25 of the static member 5 and the movable member 6 of the position assurance member 2 are formed in one piece, the first plug arm 24 and second plug arm 25 have a spring effect. When pushing in the position assurance member 2, the first plug arm 24 and second plug arm 25 are pushed over the first spring arms 31 of the plug 1 and thus are additionally pre-tensioned.

By applying pressure to the activator 12, the movable member 6 of the position assurance member 2 is shifted into the transport position 28. The compressive force is hereby taken up via the first spring member 9 and the second spring member 10 as well as the abutment members 14 on the shoulder 15 of the plug 1, which serves as an abutment. At the same time, the second catch 18 engages the plug projection 30 of the plug 1. The initial tension of the first spring member 9 and the second spring member 10 keeps the second catch 18 engaged. Thereby, the plug 1 and the position assurance member 2, respectively, are fixed in the transport position 28 in a direction of the spring tension. Fixing in the opposite direction is done by the second spring arm 36, which engages between the first extension 20 and the second extension 21 and thus blocks any movement of the movable member 6 of the position assurance member 2 in a plug-in direction R of the plug 1, as shown in FIGS. 3-4. The transport position 28 of the plug 1 is thus fixed in both directions and protected against any inadvertent actuation.

When inserting the plug 1 into the socket 33, the plug arm projections 27 of the first plug arm 24 and second plug arm 25, which are pre-tensioned by spring power, lock into the second recesses 32 in the socket 33 and fix the plug 1 in the socket 33. At the same time, the second spring arm 36 is displaced from the initial position and releases the first extension 20 and the second extension 21 of the movable member 6 of the position assurance member 2. The movable member 6 of the position assurance member 2 can now be moved further down in the plug-in direction R of the plug 1 by applying a pressure on the activator 12. The pressure is supported by the first spring member 9 and the second spring member 10 on the plug 1. Simultaneously, the first extension 20 and the second extension 21 are pushed further down and thereby pressed against the contact spring 35 of the shorting contact 34 of the socket 33. The latter is thus displaced from its initial position and the shorting contact 34 is broken. On reaching the end position 37, the first catch 17 locks into the plug projection 30 of the plug 1.

During displacement of the movable member 6, static member 5 of the position assurance member 2 remains in its initial position. In this way, the end position 37 of the plug 1 and the position assurance member 2, respectively, is fixed and secured against loosening.

Through the separately mountable position assurance member 2 construction, the remainder of the plug 1 can be kept simple. The static member 5 of the position assurance member 2 ensures good guidance of the plug 1 when inserting the plug 1 into the socket 33 and good fixing of the plug 1 therein. The movable member 6 of the position assurance member 2 allows good power transmission and thereby good and secure breaking of the shorting contact 34 so that current cannot flow in the shorting contact 34. Due to the functional division of the position assurance member 2, the static member 5 as well as the movable member 6 can be designed specifically for the function to be fulfilled by each.

When the movable member 6 of the position assurance member 2 has a toggle mechanism, good power transmission is ensured.

The movable member 6 of the position assurance member 2 can advantageously be designed as one piece, thereby simplifying the construction of the plug 1.

When the movable member 6 of the position assurance member 2 is designed as a spring member which pre-tensions the movable member 6 in direction of the transport position 28, the position assurance member 2 is always kept in the transport position 28 and is protected, for example, from being inadvertently moved during transport.

When the position assurance member 2 and the static member 5 of the position assurance member 2 are designed as one piece, the construction of the plug 1 is simplified, and moreover, the plug 1 is easily manufactured, for example, by injection molding.

At least one catch can advantageously be provided on the movable member 6, with the help of which the position assurance member 2 can be fixed in the transport position 28. In this way, the position assurance member 2 is protected from inadvertent actuation, for example, during transport.

When at least two catches are provided on the movable member 6 of the position assurance member 2, with the first catch 17 serving to fix the position assurance member 2 in the transport position 28 and the second catch 18 serving to fix the position assurance member 2 in the end position 37, the position assurance member 2 can be fixed both in the transport position 28 and the end position 37 and therefore be protected from unintentional actuation and unintentional loosening, respectively, of the position assurance member 2.

When the movable member 6 of the position assurance member 2 can be moved in parallel with a direction in which the plug 1 is inserted into the socket 33, handling of the plug 1 is simplified. It is possible to insert the plug 1 into the socket 33 as well as to shift the position assurance member 2 into the end position 37 with one movement of the hand.

With the plug 1 being outside the socket 33, the movable member 6 of the position assurance member 2 can abut against a shoulder 15 of the plug 1. Therefore, as long as the plug 1 is outside the socket 33, the position assurance member 2 is fixed in the transport position 28.

With the plug 1 being outside the socket 33, the movable member 6 of the position assurance member 2 can be fixed in the transport position 28 by the shoulder 15 of the plug 1. This prevents inadvertent shifting of the position assurance member 2 into the end position 37, for example, during transport or handling.

When the shoulder 15 of the plug 1 is designed as a movable spring member, the shoulder 15 can be shifted during insertion of the plug 1 into the socket 33 and thus be disengaged from the position assurance member 2. When removing the plug 1 from the socket 33, the shoulder 15 returns to its initial position with the help of spring tension and so ensures proper functioning of the plug 1.

The shoulder 15 can advantageously be movable in a state in which it releases the movable member 6 of the position assurance member 2. This enables the position assurance member 2 to be shifted into the end position 37. For example, the shoulder 15 can be moved by a contact face of the socket 33 when the plug 1 is inserted into the socket 33.

When the static member 5 of the position assurance member 2 has at least two plug arms, which in relation to a longitudinal axis 26 of the plug 1, are approximately opposite each other and slant outward, the plug arms slide along the socket wall as the plug 1 penetrates the socket 33 to ensure good guidance of the plug 1. At the same time, the plug 1 is fixed in the socket 33 by the outward slanting plug arms.

When the static member 5 of the position assurance member 2 has at least one projection which engages in a second recess 32 in the socket 33 when the plug 1 is inserted therein, the plug 1 is locked in the socket 33 when the plug 1 is inserted into the socket 33 and is thus secured against inadvertent loosening.

When the static member 5 of the position assurance member 2 has at least two projections which engage in second recesses 32 in the socket 33 when the plug 1 is inserted therein and which in relation to the longitudinal axis 26 of the plug 1 are approximately opposite each other, good power transmission and thus good protection of the plug 1 in the socket 33 is ensured.

The plug 1 can have at least two spring arms which abut against an internal wall of the static member 5 of the position assurance member 2.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

The invention claimed is:

1. A plug for a socket of an airbag, the plug comprising:

a position assurance member having a movable member and a static member, the position assurance member being movable between a transport position and an end position by moving the movable member in relation to the static member; and a shorting contact, allowing a flow of current through the shorting contact when the position assurance member is in the transport position and preventing the flow of current when the position assurance member is in the end position;

wherein the end position is attainable only when the plug is inserted into the socket.

2. The plug according to claim 1, wherein the movable member comprises a toggle mechanism.

3. The plug according to claim 1, wherein the movable member is formed as one piece.

4. The plug according to claim 1, wherein the position assurance member comprises a spring member which pre-tensions the movable member in a direction of the transport position.

5. The plug according to claim 1, wherein the movable member and the static member are formed as one piece.

6. The plug according to claim 1, wherein a catch is provided on the movable member that secures the position assurance member in the transport position.

7. The plug according to claim 1, wherein at least two catches are provided on the movable member, with one of the at least two catches configured to secure the position assurance member in the transport position and the other of the at least two catches configured to secure the position assurance member in the end position.

8. The plug according to claim 1, wherein the movable member is movable parallel to a direction in which the plug is inserted into the socket.

9. The plug according to claim 1, wherein when the plug is outside of the socket, the movable member of the position assurance member abutting against a shoulder of the plug.

10. The plug according to claim 9, wherein when the plug is outside of the socket, the movable member of the position assurance member is secured in the transport position by the shoulder.

11. The plug according to claim 9, wherein the shoulder comprises a movable spring member.

12. The plug according to claim 9, wherein the shoulder is movable into a state in which it releases the movable member.

13. The plug according to claim 1, wherein the static member comprises at least two plug arms which are approximately opposite each other in relation to a longitudinal axis of the plug and slant outward.

14. The plug according to claim 1, wherein the static member comprises at least one projection that engages in a recess of the socket when the plug is inserted into the socket.

15. The plug according to claim 1, wherein the static member comprises at least two projections that engage in recesses of the socket when the plug is plugged into the socket, the at least two projections being approximately opposite each other in relation to a longitudinal axis of plug.

16. The plug according to claim 1, wherein the plug comprises at least two spring arms that abut against an inside wall of the static member.

* * * * *